US011313083B2

(12) United States Patent
Payán et al.

(10) Patent No.: US 11,313,083 B2
(45) Date of Patent: Apr. 26, 2022

(54) RAIL ANCHOR APPLICATOR AND CRIBBER APPARATUS

(71) Applicant: NORDCO INC., Oak Creek, WI (US)

(72) Inventors: Julio Enrique Payán, Milwaukee, WI (US); Mark Daniel David, Milwaukee, WI (US)

(73) Assignee: NORDCO INC., Oak Creek, WI (US)

( * ) Notice: Subject to any disclaimer, the term of this patent is extended or adjusted under 35 U.S.C. 154(b) by 210 days.

(21) Appl. No.: 16/582,823

(22) Filed: Sep. 25, 2019

(65) Prior Publication Data

US 2020/0109521 A1 Apr. 9, 2020

Related U.S. Application Data

(60) Provisional application No. 62/806,043, filed on Feb. 15, 2019, provisional application No. 62/741,191, filed on Oct. 4, 2018.

(51) Int. Cl.
*E01B 27/04* (2006.01)

(52) U.S. Cl.
CPC ..... *E01B 27/04* (2013.01)

(58) Field of Classification Search
CPC ..... E01B 27/00; E01B 27/04; E01B 29/00; E01B 29/24; E01B 29/32; E01B 13/02
See application file for complete search history.

(56) References Cited

U.S. PATENT DOCUMENTS 2,358,657 A * 9/1944 McWilliams ..... E01B 27/10 37/104
3,380,180 A * 4/1968 Speno ..... E01B 27/107 37/105
3,403,462 A 10/1968 Speno
3,457,660 A 7/1969 Speno
3,553,859 A * 1/1971 McIlrath ..... E01B 27/04 37/104
3,841,221 A * 10/1974 Dieringer ..... E01B 29/32 104/17.2
4,119,154 A * 10/1978 Miller ..... E01B 27/021 104/7.3
4,464,995 A * 8/1984 Nameny ..... E01B 27/026 104/9
4,843,967 A 7/1989 Whitaker, Jr.
4,850,123 A * 7/1989 Whitaker, Jr. ..... E02F 3/20 37/104
4,967,847 A 11/1990 Whitaker, Jr.
5,046,270 A 9/1991 Theurer et al.
5,052,133 A 10/1991 Mohr
(Continued)

FOREIGN PATENT DOCUMENTS

EP 0239712 A1 10/1987

*Primary Examiner* — Jessica H Lutz
(74) *Attorney, Agent, or Firm* — Greer, Burns & Crain, Ltd

(57) ABSTRACT

An apparatus for cribbing and anchor attachment on rails of a railroad track, including a frame movable along the track, at least one dual function workhead mounted to the frame that is moveable into and out of operational position relative to the track, an anchor applicator tool pivotably mounted to each workhead, and a cribber tool mounted to each workhead and adjacent the anchor applicator tool. Each anchor applicator tool and cribber tool is movable under operator control relative to the workhead from a retracted position to a work position.

20 Claims, 11 Drawing Sheets

(56) References Cited

U.S. PATENT DOCUMENTS

| | | | | | |
|---|---|---|---|---|---|
| 5,125,345 | A * | 6/1992 | Theurer | E01B 29/10 | 104/9 |
| 5,142,987 | A * | 9/1992 | Freymuth | E01B 29/32 | 104/17.2 |
| 5,201,127 | A * | 4/1993 | Whitaker, Jr. | E01B 27/021 | 104/2 |
| 5,694,856 | A * | 12/1997 | Theurer | E01B 29/32 | 104/17.2 |
| 5,706,734 | A | 1/1998 | Theurer | | |
| 5,926,981 | A * | 7/1999 | Theurer | E01B 27/04 | 37/104 |
| 6,598,325 | B2 * | 7/2003 | Theurer | E01B 27/04 | 104/7.3 |
| 7,647,871 | B2 * | 1/2010 | Claas | E01B 13/02 | 104/17.2 |
| 7,694,631 | B2 * | 4/2010 | Claas | E01B 29/32 | 104/17.2 |
| 8,844,445 | B2 | 9/2014 | Brenny et al. | | |
| 2013/0125775 | A1 * | 5/2013 | Brenny | E01B 27/04 | 104/2 |

* cited by examiner

RAIL ANCHOR APPLICATOR AND CRIBBER APPARATUS

RELATED APPLICATIONS

This application is related to, and claims 35 USC 119 priority from, U.S. Provisional Application Ser. No. 62/806,043 filed Feb. 15, 2019, and from U.S. Provisional Application Ser. No. 62/741,191 filed Oct. 4, 2018, both of which are incorporated by reference.

BACKGROUND

The present invention relates generally to railroad right-of-way maintenance machinery, and specifically to machinery used for applying anchors to rails for maintaining track alignment.

A railway anchor clamps onto a rail, and is positioned to abut the tie and in some cases the tie plate, to resist the movement of the rail relative to the tie in a perpendicular direction. "Rail anchors" include different configurations and models of anchors, such as spring-type or drive-on anchors made by different manufacturers, or any other rail fasteners positioned adjacent to ties, as are known to those skilled in the art.

During the course of railroad maintenance work, it is common that existing rail anchors are removed during the replacement of rail ties, tie plates, rails and for other maintenance operations. Once the desired maintenance is complete, the anchors need to be reinstalled. Alternatively, the anchors themselves can fail and new anchors need to be installed in their place. New anchors may be deemed necessary in existing track for a variety of reasons.

A known anchor replacement machine is disclosed in commonly-assigned U.S. Pat. No. 7,647,871 which is incorporated by reference here. The '871 machine features a pivoting anchor applicator clipping mechanism which pivots from a gauge position between the rails, to a position beneath the rails towards the field side or outside of the track.

A common track maintenance procedure is known as cribbing, where a selected amount of rail ballast, or the loose rocks used to anchor and level the track, are displaced in the vicinity of the desired placement location for the new anchor. In practice, owners of the machines described in the '871 patent have been known to employ the anchor applicator clipping mechanism as a cribbing tool. After prolonged use in the abrasive ballast, the anchor clipping mechanisms become prematurely worn to the point where they are unsuitable for use in anchor applicating, and must be replaced.

Thus there is a need for an improved rail maintenance machine which addresses the needs described above.

SUMMARY

The above-listed need is met or exceeded by the present rail anchor applicator and cribber apparatus, which features a frame movable along the track and having at least one dual function workhead that is moveable into and out of operational position relative to the track. On the workhead are two pivotable tools, an anchor applicator tool and a cribber tool. Both tools are pivotable relative to the workhead under operator control. In one embodiment, a ballast-engaging wear part of the cribber tool or cribber plate is pivotable between a first position that engages the anchor and a second position that is clear of the anchor. During movement of the machine to the work location, both tools are maintained in a retracted position.

When anchor application is desired, the operator activates rail clamps and preferably a rail latch to hold the machine in position at that location on the track, and to counteract the operational forces of cribbing and anchor operation as is well known in the railway maintenance art. The operator then lowers the workhead into an intermediate position. First, the cribber tool is pivotally extended from a retracted position to a work position, in which an arm having a ballast pushing surface at a free end is placed adjacent a top surface of the ballast, near a top surface of adjacent rail ties. Also, an anchor is provided through a nearby magazine, as is described in the prior U.S. Pat. Nos. 7,647,871 and 7,694,631 incorporated by reference. Once the new anchor is in place on the applicator tool, a cribbing motion is then performed, initiated by a downward pivoting action of the workhead, moving in an arc from the gauge side to the field side of the track. Through this movement, a select portion of ballast is displaced, temporarily clearing a region near the foot of the next adjacent rail.

The downward pivoting motion of the workhead along the same arc used for the cribbing tool causes the application of the anchor onto the foot of the rail. Upon completion of anchor application, the workhead returns to the intermediate position, and the anchor applicator tool is retracted. In one embodiment, featuring the pivoting cribber tool wear part or cribber plate, a combined anchor applicator tool and cribber tool working in unison, the cribber tool wear part pivots away from the anchor as the applicator tool is retracted. The machine then is movable to the next operational location.

More specifically, an apparatus is provided for cribbing and anchor attachment on rails of a railroad track, including a frame movable along the track, at least one dual function workhead mounted to the frame that is moveable into and out of operational position relative to the track, an anchor applicator tool pivotably mounted to each workhead, a cribber tool pivotably mounted to each workhead and adjacent the anchor applicator tool. Each anchor applicator tool and cribber tool is movable under operator control relative to the workhead from a retracted position to a work position.

In an embodiment, a rail latch, with an optional latching bar is provided for more securely retaining the apparatus in position on the track. Also, in an embodiment, the workhead pivots from a gauge side of a target rail of the track to a field side of the target rail. In another embodiment, the anchor applicator tool and the cribber tool are operated in unison, so that the cribbing and anchor application functions are performed virtually simultaneously. Another feature of this embodiment is that the cribber tool is pivotable between a first position adjacent the anchor just applied to the rail, and a second position that is clear of or free of engagement with the recently applied anchor.

In another embodiment, a method is provided for applying rail anchors to a railroad track, including moving a rail cribber and anchor applicator machine along the track to a designated location, the machine having at least one anchor applicator and cribber workhead, activating at least one rail clamp on the applicator apparatus for holding the machine tightly to the track, lowering the workhead to an intermediate position, extending a cribber tool on the workhead from a retracted position to a work position, in which an arm having a ballast pushing surface at a free end is placed adjacent a top surface of the ballast, near a top surface of adjacent rail ties, pivoting the workhead to create a cribbing action in the ballast, retracting the cribber tool, extending an anchor applicator tool on the workhead from a retracted position to a work position in which an anchor is supplied to a free end of said anchor applicator tool, pivoting the workhead to apply the anchor onto a foot of a target rail of the track, retracting the anchor applicator tool, and raising the workhead from the intermediate position to a travel position.

In still another embodiment, a method is provided for applying rail anchors to a railroad track, including moving a rail cribber and anchor applicator machine along the track to a designated location, the machine having a workhead with at least one anchor applicator tool and at least one cribber tool, activating at least one rail clamp on the applicator apparatus for holding the machine tightly to the track, lowering the workhead to an intermediate position, extending the cribber tool on the workhead from a retracted position to a work position, in which an arm having a ballast pushing surface at a free end is placed adjacent a top surface of the ballast, near a top surface of adjacent rail ties, extending the anchor applicator tool on the workhead from a retracted position to a work position, applying an anchor is supplied to a free end of said anchor applicator tool, pivoting the workhead to create a cribbing action in the ballast, and pivoting the workhead to apply the anchor onto a foot of a target rail of the track, retracting the anchor applicator tool, retracting the cribber tool so that a cribber plate is pivoted out of engagement with the anchor, and raising the workhead from the intermediate position to a travel position.

DETAILED DESCRIPTION

Figure 1:
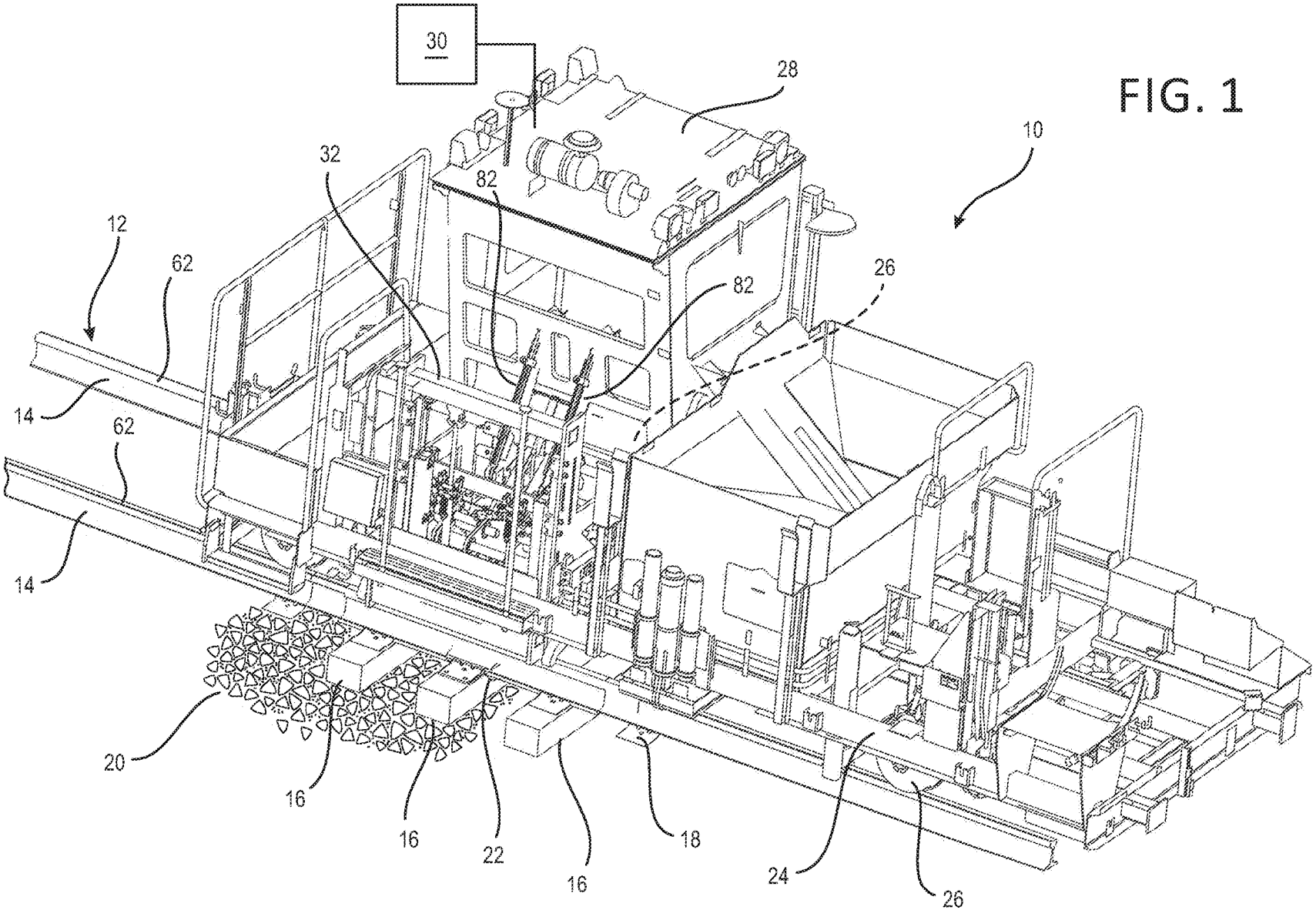
FIG. 1 is a top perspective view of the present rail anchor applicator machine shown on a railroad track.

Referring now to FIG. 1, a railway maintenance machine suitable for use with the present anchor/cribber apparatus is generally designated 10, and is configured for movement along a railroad track 12, made up of a pair of parallel rails 14, transversely oriented rail ties 16, and rail tie plates 18 supporting the rails upon the ties and being held in place using spikes or other fasteners, as are well known in the art. Also, the rail ties 16 are supported by a bed of rock ballast 20, also well known in the art. Another component of the railroad track 12 is a rail anchor 22 (FIG. 3), a banana-shaped metal clip that is secured to a foot or base of the rail 14, and prevents one rail from moving longitudinally in the ballast 20 relative to the transverse ties 16.

During railway maintenance operations, particularly the replacement of rail ties 16, rail anchors 22 are usually removed by an anchor remover machine of the type generally described in U.S. Pat. No. 5,546,864 incorporated by reference. Anchor spreaders and anchor squeezers are often used in rail maintenance operations for sliding anchors out of the way during tie replacement without removing them. Once the tie 16 is replaced, it is customary for anchors 22 to be reattached to the rail 14. The machine 10 is designed to perform maintenance tasks upon the track 12, particularly the application of new anchors and also the displacement or clearance of ballast 20 away from the anchor application site just prior to anchor application. This latter process is known as cribbing.

As is the case with many railway maintenance machines, the machine 10 is preferably self-propelled, although a non-powered, towed unit is also contemplated. Included on the machine 10 is a frame 24 to which rail wheels 26 are rotatably attached for engaging the track 12, a power unit 26 including an engine and a hydraulic system (shown hidden), and an operator's cab 28 including a control system 30.

Figure 2:
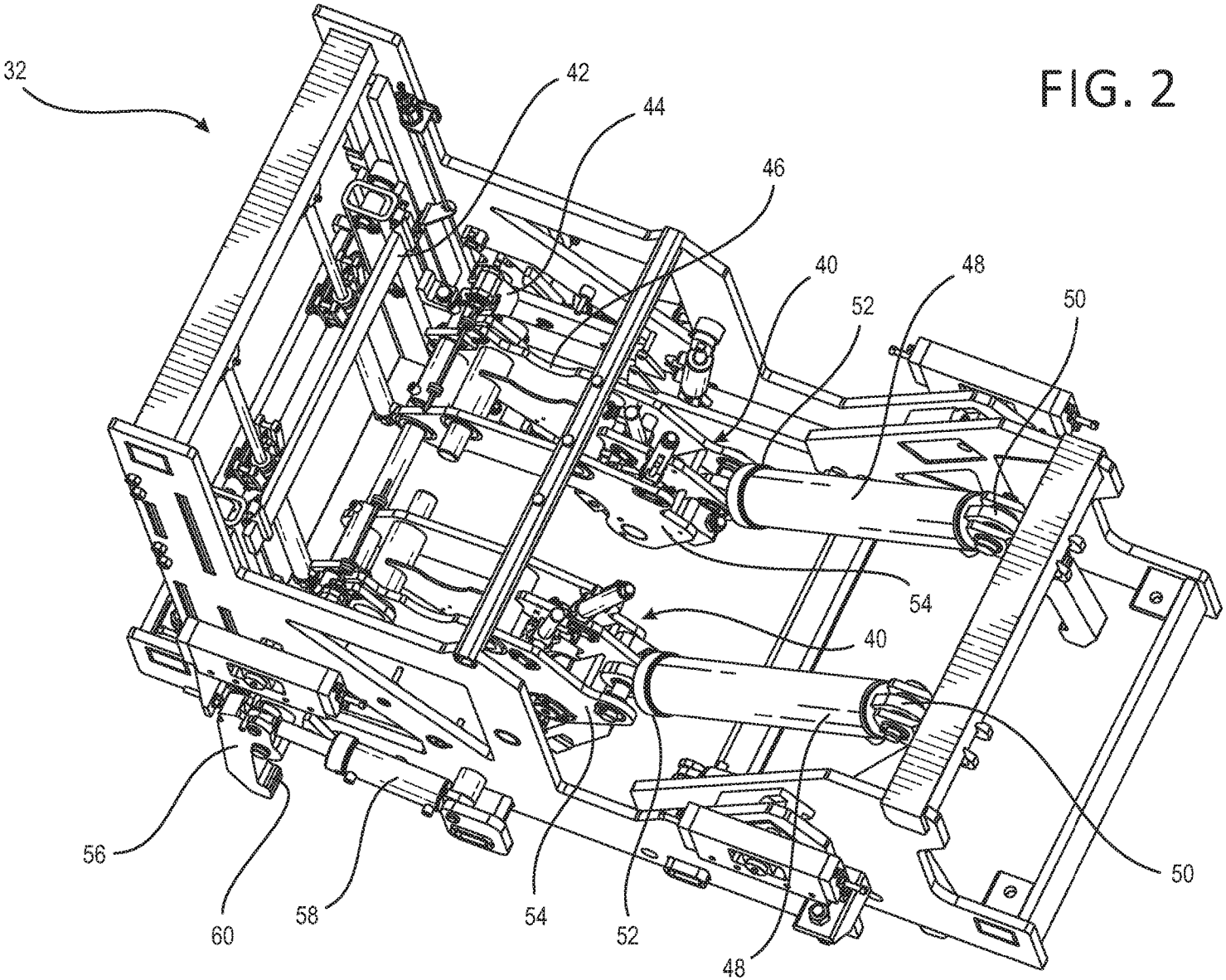
FIG. 2 is a fragmentary top perspective view of the carriage of the present anchor applicator bearing a pair of workheads.

Referring now to FIGS. 1 and 2, also connected to the frame 24 is at least one and optionally two workhead frames 32 which are each provided with at least one and preferably two anchor applicator/cribber workhead apparatus assemblies 40. Each workhead assembly 40 is provided with an up/down sled 42, a pivoting frame 44, a boxing frame 46 and a fluid powered, preferably hydraulic drive cylinder 48 connected at one end 50 to the workhead frame 32, and at an opposite end 52 to a dual function workhead 54.

Figure 3:
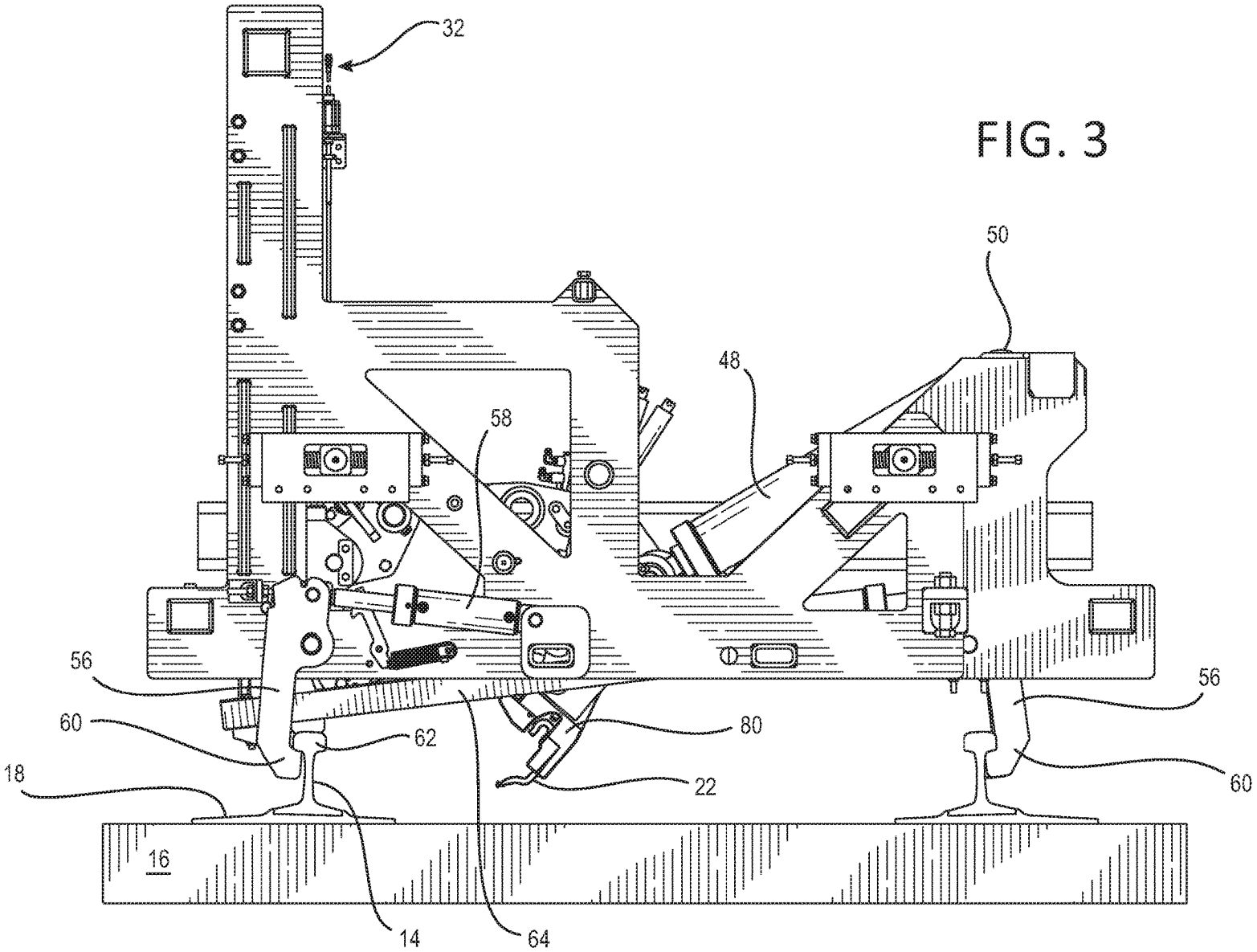
FIG. 3 is a fragmentary front view of the machine of FIG. 1 showing the rail clamp and latch apparatus.

Referring now to FIGS. 2 and 3, also included on the workhead frame 32 is at least one rail clamp 56, each operated by an associated rail clamp fluid powered cylinder 58. As is known in the art, the rail clamps 56 pivot between a retracted position and an engaged position, the latter where a lower end 60 of the clamp 56 engages the track beneath a head 62 of the rail 14. One of the clamps 56 is provided for each of the rails 14, and once engaged, the clamps 56 hold the machine 10 securely to the track 12 in a way that withstands forces generated during the cribbing and anchor application processes described below.

Also provided to the workhead frame 32 is at least one latching bar 64 that also engages the rail head 62 for additional fastening action when desired.

Figure 4:
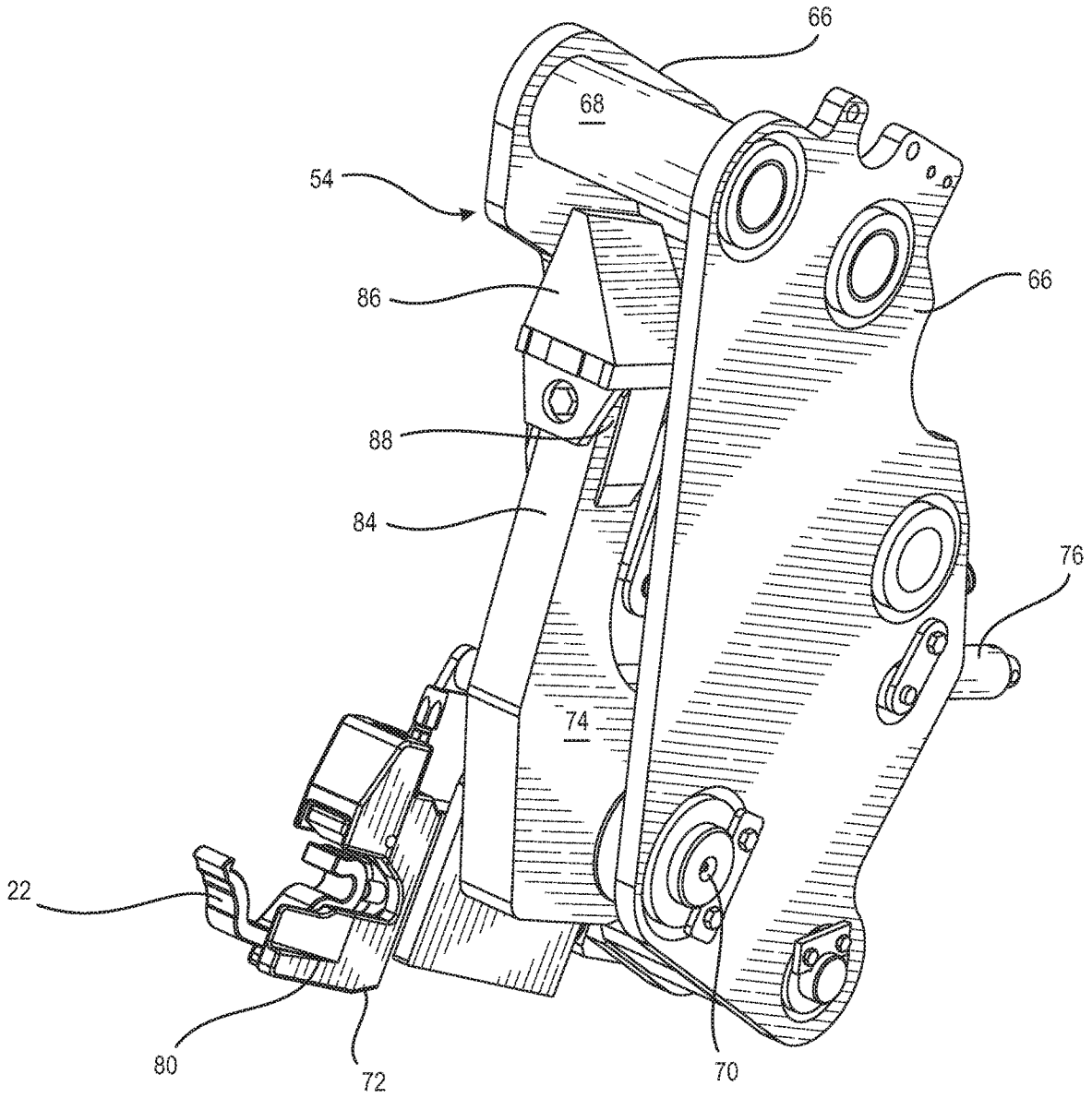
FIG. 4 is a fragmentary top perspective view of the present multi-tool workhead showing the tools in the partially retracted position.
Figure 5:
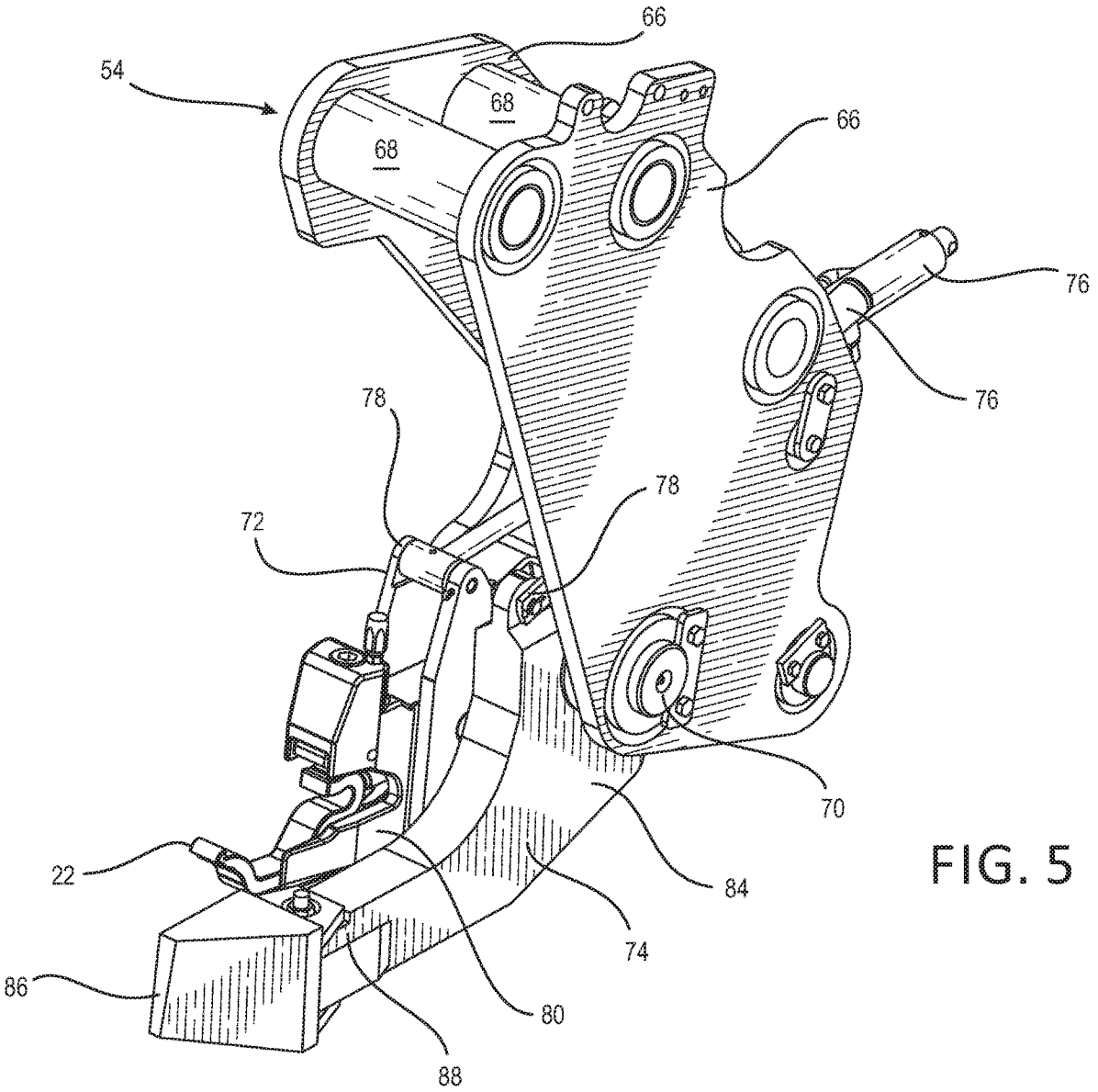
FIG. 5 is a fragmentary top perspective view of the present multi-tool workhead showing the tools in an extended position.

Referring now to FIGS. 4 and 5, the workhead 54 is shown in greater detail. A pair of parallel plates 66 are held in spaced relationship by tubes 68, which also serve as connection points to the respective up/down sled 42 and the pivoting frame 44. Through the operation of these components, the workhead 54 is moved from a travel position, held above the track 12 a sufficient distance to clear operational components from impact from obstacles encountered while the machine 10 moves from worksite to worksite, to an intermediate position, where the workhead is lowered from the travel position by the up/down sled 42.

Also located between the plates 66 and pivotally mounted to a pivot point or post 70 are an anchor applicator tool 72 and a cribber tool 74. Each of the tools 72, 74 is pivoted between a retracted position (FIG. 4) to a work or lowered position (FIG. 5) by an associated fluid power tool cylinder 76 and associated linkage 78. The anchor applicator tool 72 has a jaw 80 that is configured for temporarily retaining an anchor 22 provided by an anchor magazine 82 (FIG. 1) of the type disclosed in commonly-assigned, U.S. Pat. Nos. 7,647,871 and 7,694,631 incorporated by reference.

The cribber tool 74 is preferably located adjacent the anchor applicator tool, and includes a long arm with a cribber plate 84 mounted on a free end, opposite a pivot end 86. As the dual function workhead 54 moves to the work position under control of the up/down sled 42, the tools 72, 74 are placed in closer proximity to the target rail 14. The workhead 54 is moved along an arc from the gauge side of the rail to the field side. Thus, once the appropriate tool 72, 74 is lowered to the operational position, each of the tools will follow the same arcuate motion.

During movement of the machine to the work location, both tools 72, 74 are maintained in the retracted position (FIG. 4). When anchor application is desired at a target location, the operator activates the rail clamp 56 and preferably the rail latching bar 64 to hold the machine 10 in position at that location on the track 12, and to counteract the operational forces of cribbing and anchor operation as is well known in the railway maintenance art. Using the control system 30, the operator then lowers the workhead 54 into an intermediate position shown in FIG. 3. First, the cribber tool 74 is pivotally extended from a retracted position to a work position (FIG. 5), in which an arm 84 having a cribber plate 86 or ballast pushing surface at a free end 88 is placed adjacent a top surface of the ballast 20, near a top surface of adjacent rail tie 16.

Figure 6:
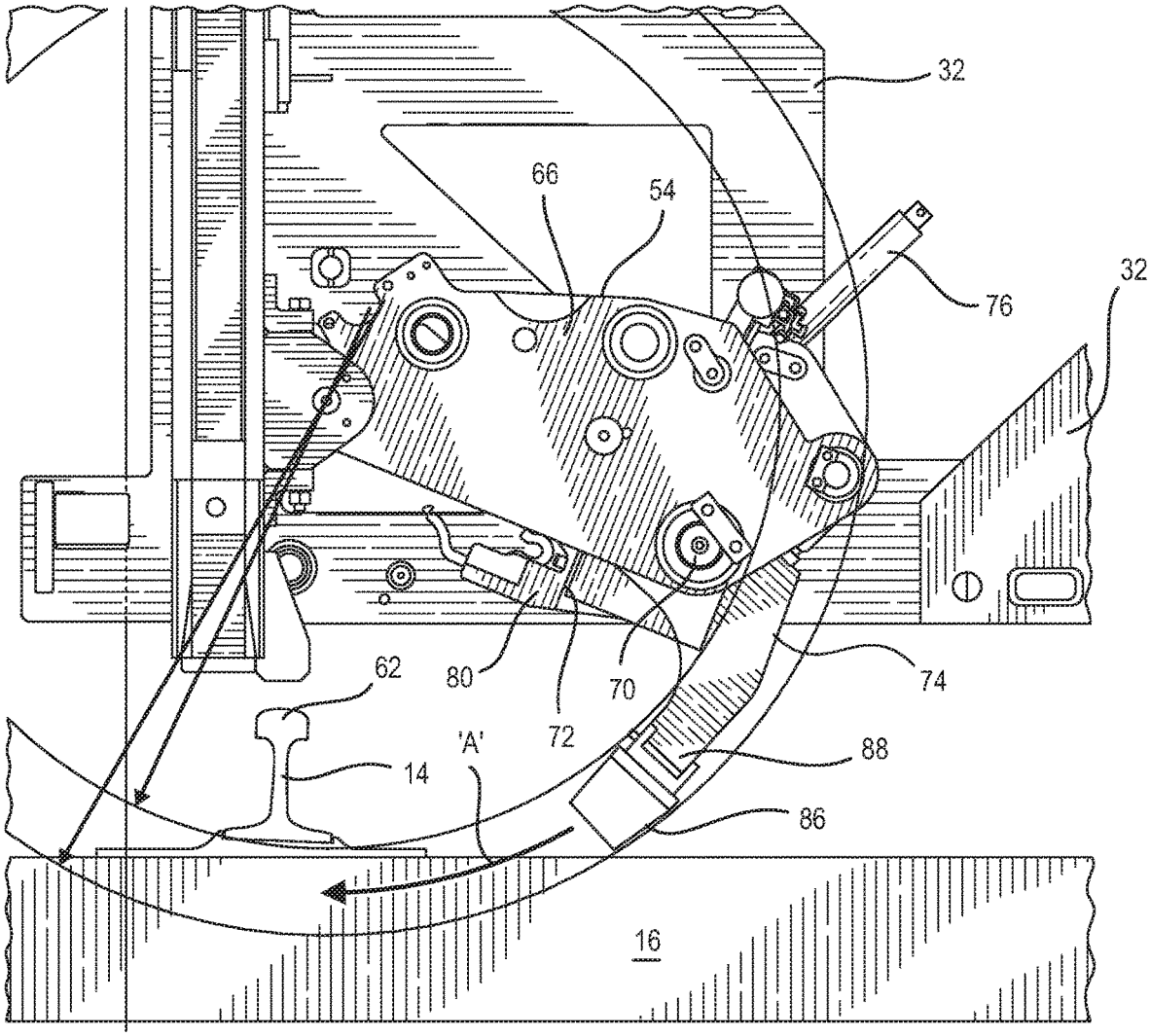
FIG. 6 is a fragmentary front view of the carriage showing the cribbing tool in motion.

Referring now to FIG. 6, a cribbing motion is then performed, initiated by a downward pivoting action of the workhead 54, moving with the cribber tool 74 in an arc 'A' from the gauge side to the field side of the track 12. Through this movement, a select, trough-like portion of ballast 20 is displaced, temporarily clearing a region near the foot of the target rail 14. Once the cribbing motion is completed, the cribber tool 74 is optionally either retracted to the intermediate or travel position, or is optionally left in the lowered, operational position as the anchor applicator tool 72 is lowered and performs its operational cycle.

Also, an anchor 20 is provided to the jaw 80 through the nearby magazine 82, as is described in the prior U.S. Pat. Nos. 7,647,871 and 7,694,631 incorporated by reference. Once the new anchor 20 is in place on the applicator tool 72, the downward pivoting motion of the workhead along the arc 'A' used for the cribbing tool 74 causes the application of the anchor onto the foot of the rail 14. Upon completion of anchor application, the workhead 54 returns to the intermediate position, and the anchor applicator tool 72 is retracted. The machine 10 then is movable to the next operational location.

Referring now to FIGS. 8-11, an alternate embodiment to the anchor applicator/cribber workhead assembly 40 is generally designated 100. Components of the assembly 100 that are shared with the assembly 40 are designated with identical reference numbers. Due to a concern that in some cases the assembly 40 operated under an unduly long cycle time, the assembly 100 features modifications designed to lower or reduce cycle time.

Specifically, a redesigned cribber plate 102 is lengthened axially in the direction of motion towards the designated rail 14. The cribber plate 102 has a front surface 104 that is angled to engage rail ballast and move it away from the desired anchor application location. Opposite the front surface 104, a rear end 106 forms a clevis joint with the cribber arm 84. Instead of being fixed to the arm 84, as is the case with the cribber plate 86, the cribber plate 102 is pivotable relative to the arm 84. The pivoting action, as well as the attachment of the cribber plate 102 to the arm 84 is achieved using a pivot pin 108. A pivot axis defined by the pivot pin 108 is generally transverse to a longitudinal axis of the cribber arm 84.

In addition, a free end 110 of the cribber arm 84 is provided with upper and lower recesses 112 that each define a shoulder 114 serving at a stop for pivoting action of the cribber plate 102. A rounded corner 116 of the rear end 106 permits pivoting action of the cribber plate 102 relative to the cribber arm 84 in one direction, away from the anchor applicator tool 72, see Arrow 'A'. A generally right-angled corner 118 prevents pivoting action in the opposite direction, towards the anchor applicator tool 72.

Figure 8:
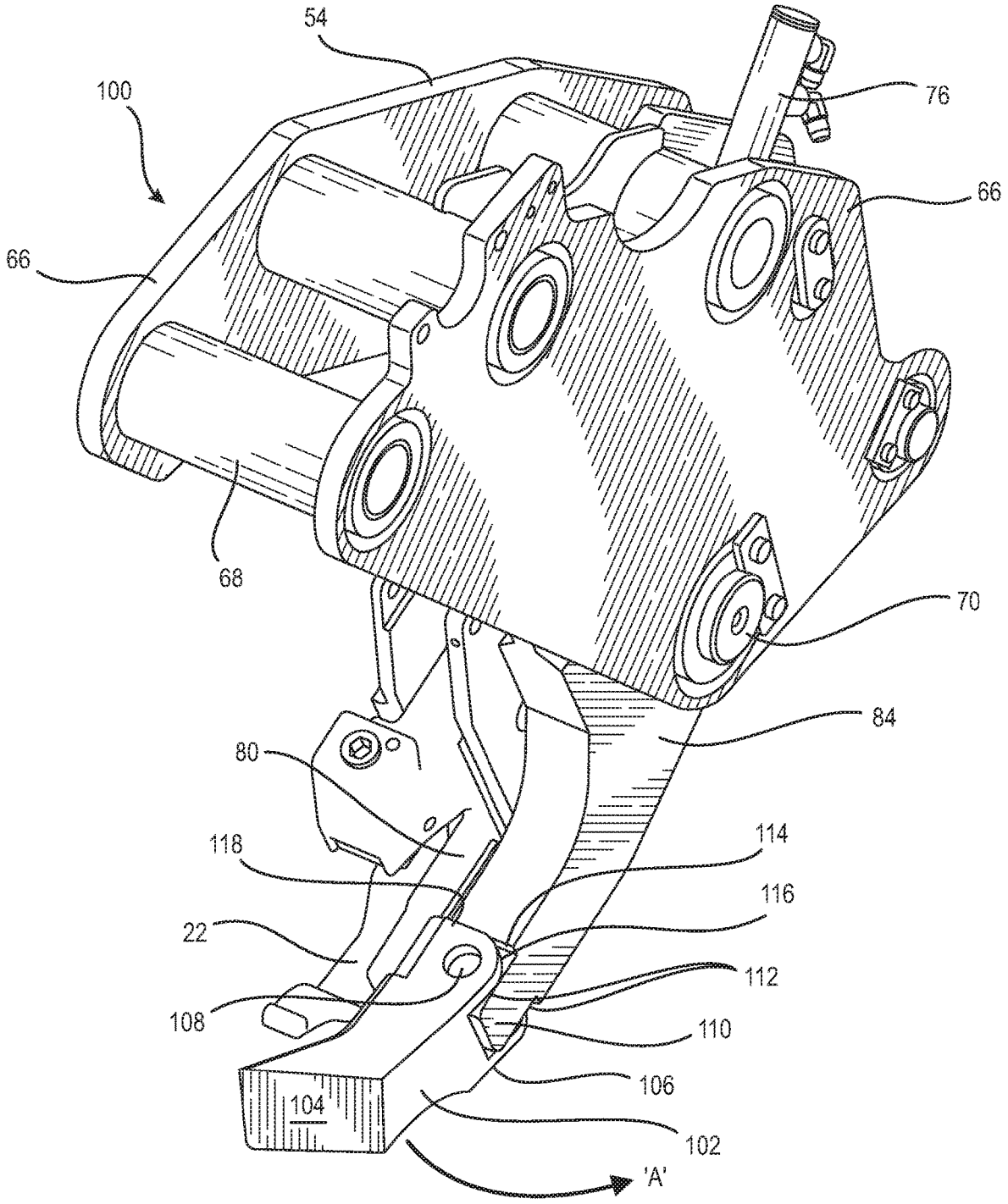
FIG. 8 is a fragmentary front perspective view of another embodiment of the present anchor applicator tool.
Figure 9:
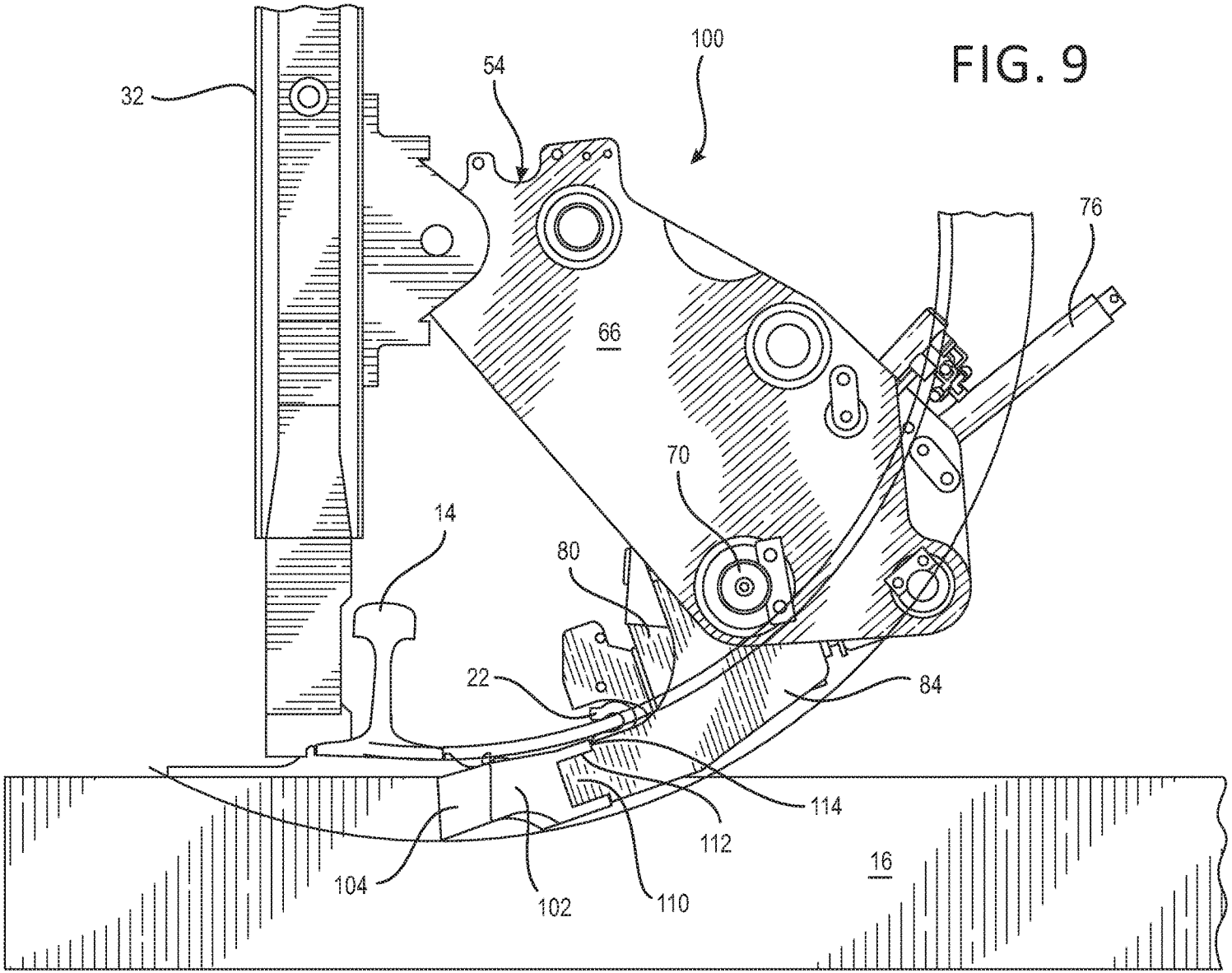
FIG. 9 is a fragmentary side elevation of the anchor applicator tool of FIG. 8 shown in an insertion position.
Figure 10:
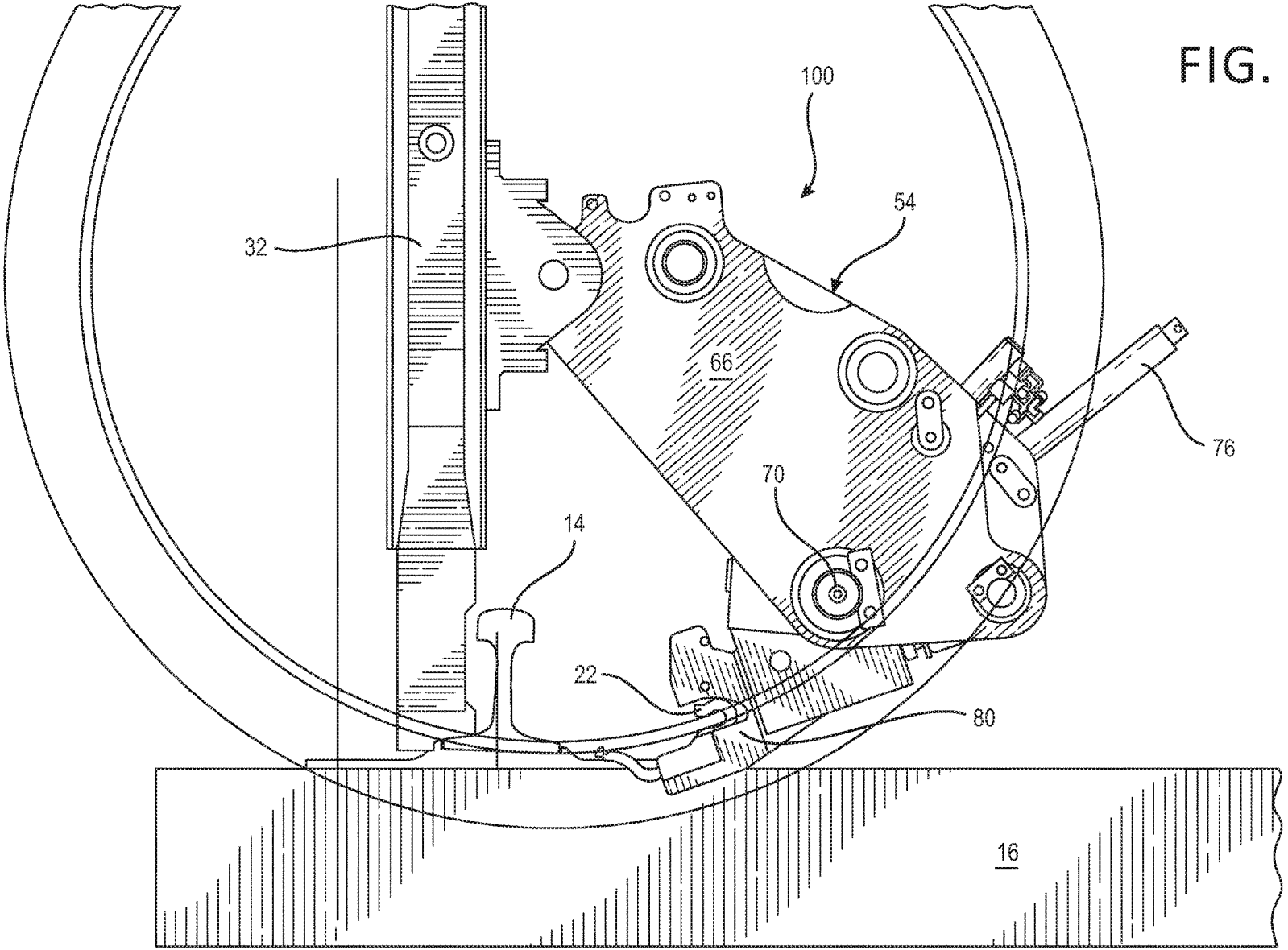
FIG. 10 is a fragmentary side elevation of the anchor applicator tool of FIG. 9 with the cribber arm removed.
Figure 11:
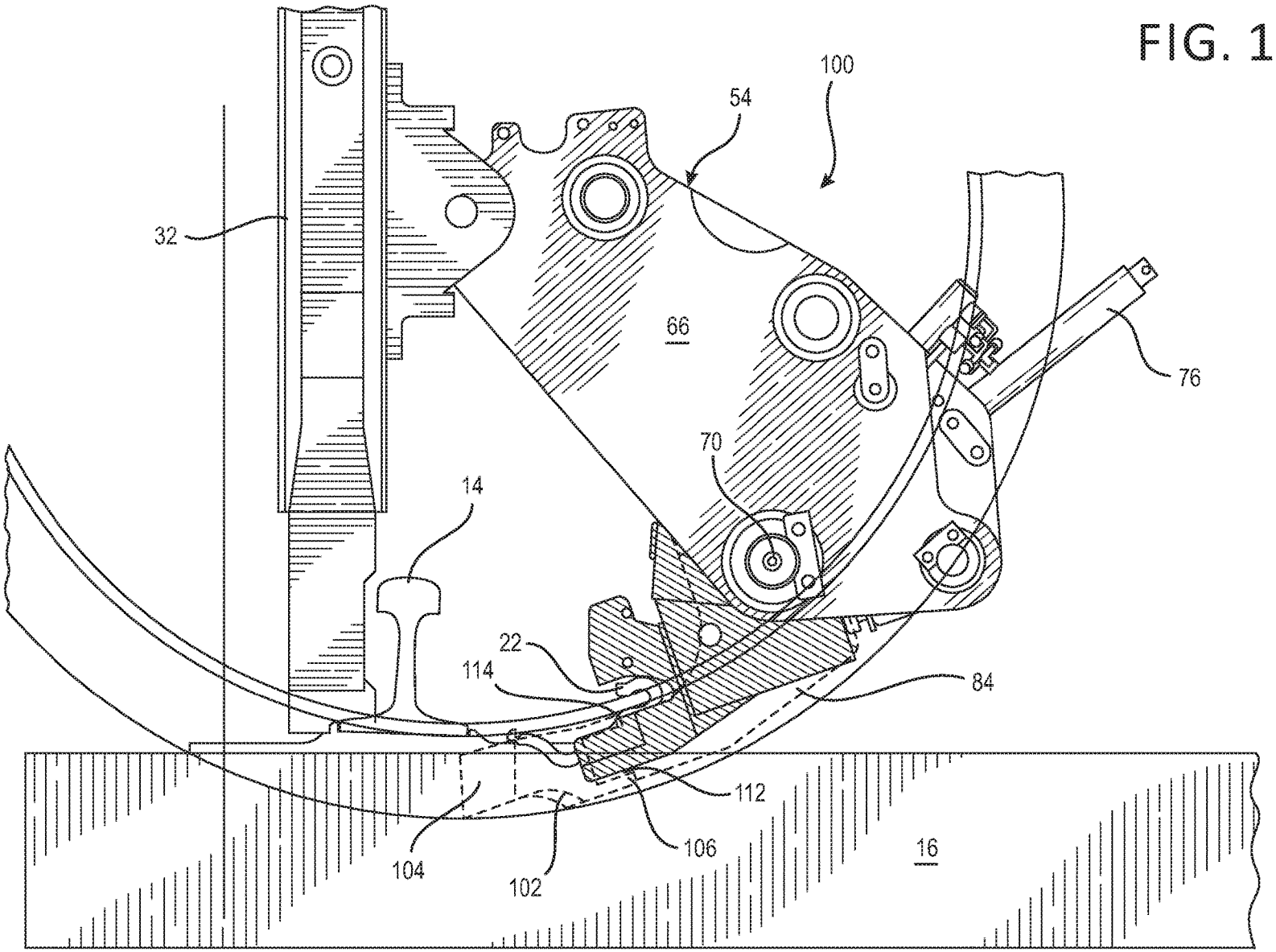
FIG. 11 is a fragmentary side elevation of the anchor applicator tool of FIG. 9 with the cribber arm shown in phantom.

By lengthening the cribber plate 102, the cribber plate 102 extends towards the rail 14 ahead of the anchor applicator tool 72. The assembly 100 is pivotable towards the target rail 14 with both the anchor applicator tool 72 and the cribber tool 74 engaged in the work position (FIGS. 5 and 8). Thus, the tools 72, 74 preferably move simultaneously towards the rail 14. As the workhead 54 pivots the tools 72, 74 towards the rail 14, the longer cribber tool 102 clears a path through the ballast 20. At the end of the work position pivoting arc, the anchor applicator tool 72, previously supplied with an anchor 22, is urged forward in a pivoting action to apply the anchor upon the rail 14 as previously described. This operation has been found to reduce the cycle time compared to the apparatus 40.

For more efficient operation, the cribber tool 102 needs to be free of engagement with the rail 14 and the installed anchor 22. Thus, as the workhead 54 retracts backwards after anchor installation, the cribber plate 102 pivots along the arc 'A' away from the anchor 22.

Figure 7:
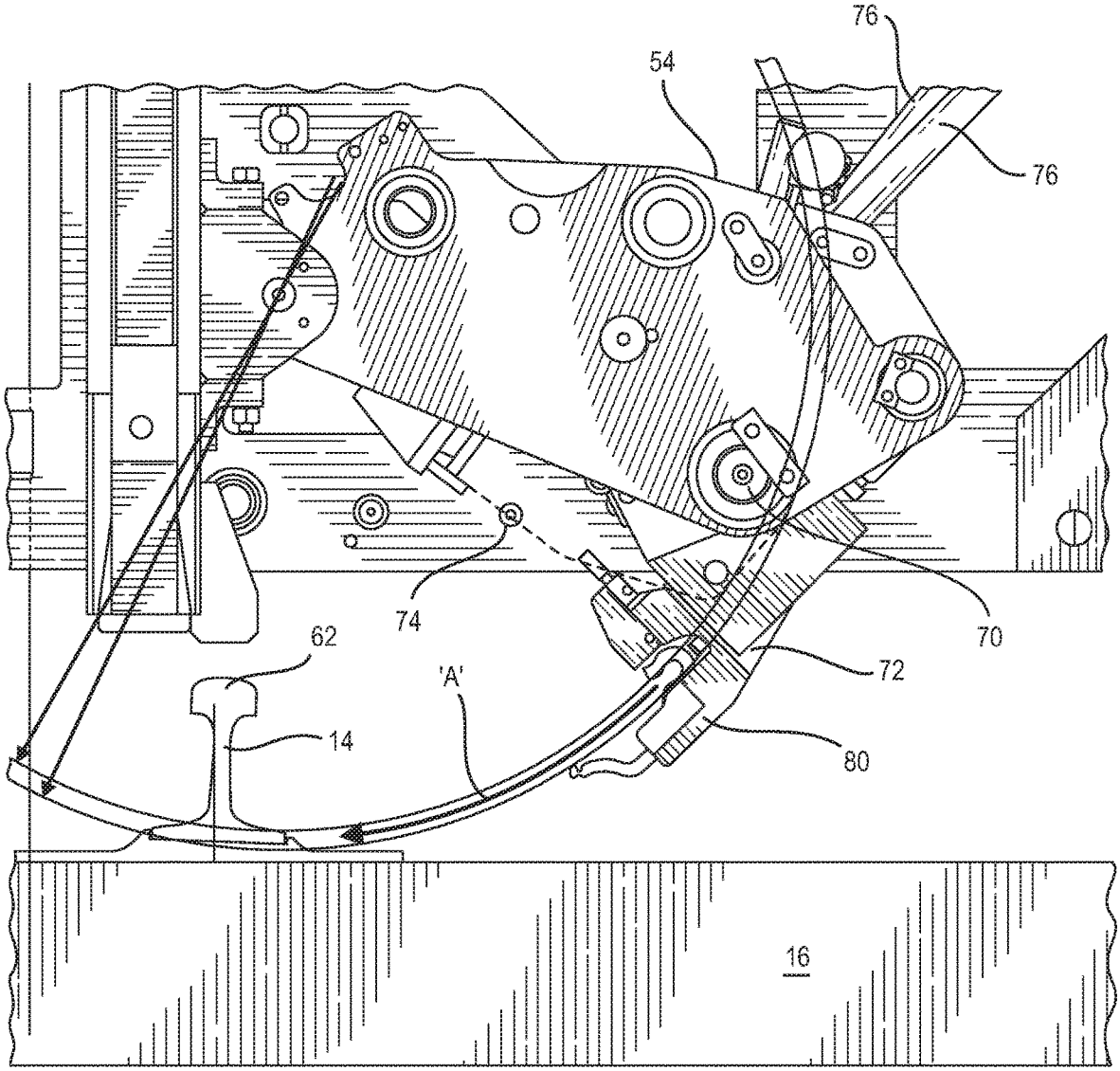
FIG. 7 is a fragmentary front view of the carriage showing the anchor applicator tool in motion.

In a modified embodiment, the workhead bearing the tools 72, 74 with the extended cribber plate 102 is pivoted less than a full operational arc towards the rail 14. Then, the cribber tool 74 is retracted, and the anchor applicator tool 72 is urged towards the rail 14 along a full operational arc (FIGS. 6 and 7) to apply an anchor as described in relation to the apparatus 40.

In a still further modified embodiment, the longer cribber plate 102 is fixed to the cribber arm 84 and travels a shortened arc towards the rail, followed by the lowering of the anchor applicator tool 72 as described in relation to the apparatus 40.

While a particular embodiment of the present rail anchor applicator and cribber apparatus has been described herein, it will be appreciated by those skilled in the art that changes and modifications may be made thereto without departing from the invention in its broader aspects and as set forth in the following claims.

The invention claimed is:

1. An apparatus for cribbing and anchor attachment on rails of a railroad track, comprising:

a frame movable along the track;

at least one dual function workhead mounted to said frame that is moveable into and out of operational position relative to the track;

an anchor applicator tool pivotably mounted to each said workhead;

a cribber tool mounted to each said workhead and adjacent said anchor applicator tool;

each said anchor applicator tool and said cribber tool being movable under operator control relative to said workhead from a retracted to a work position; and said anchor applicator tool is pivotable relative to said workhead, said cribber tool is independently pivotable relative to said workhead, and said apparatus is constructed and arranged so that in operation, said cribber tool is moved in an arc toward a designated rail of the track to clear a path through the ballast, and is then retracted, and said anchor applicator tool then is supplied with an anchor and is pivotably moved toward the rail to apply the anchor to the rail.

2. The apparatus of claim 1, further including a rail clamp on said frame configured for holding the apparatus in position on the track.

3. The apparatus of claim 2, further including a latching bar.

4. The apparatus of claim 1, wherein said workhead pivots from a gauge side of a target rail of the track to a field side of the target rail.

5. The apparatus of claim 1, wherein said anchor applicator tool and said cribber tool are pivoted together toward a base of the rail for simultaneous cribbing and anchor application.

6. The apparatus of claim 5, wherein said cribber tool has a cribber plate mounted on a free end of a cribber arm, said cribber plate is mounted to said cribber arm to pivot about an axis that is perpendicular to a longitudinal axis of said cribber arm.

7. The apparatus of claim 6, wherein said cribber plate extends toward the rail farther than the anchor applicator tool.

8. The apparatus of claim 6, wherein said anchor applicator tool and said cribber tool are constructed and arranged so that as they are pivoted toward the rail, with an anchor mounted in said anchor applicator tool, said cribber tool clears a path through the ballast just before said anchor applicator applies the anchor to the rail.

9. The apparatus of claim 1, wherein said anchor applicator tool and said cribber tool are constructed and arranged so that an arc defined by said cribber tool is shorter than an arc defined by said anchor applicator tool.

10. The apparatus of claim 6, wherein said cribber plate is fixed to said cribber arm, and said anchor applicator tool is pivotable in a full operational arc relative to said workhead for engaging the anchor on the rail.

11. A method for applying rail anchors to a railroad track, comprising:

moving a rail cribber and anchor applicator machine along the track to a designated location, said machine having at least one anchor applicator and cribber workhead;

activating at least one rail clamp on said applicator machine for holding the machine tightly to the track;

lowering the workhead to an intermediate position;

extending a cribber tool on said workhead from a retracted position to a work position, in which an arm having a ballast pushing surface at a free end is placed adjacent a top surface of the ballast, near a top surface of adjacent rail ties;

pivoting said workhead to create a cribbing action in the ballast;

retracting said cribber tool;

extending an anchor applicator tool on said workhead from a retracted position to a work position in which an anchor is supplied to a free end of said anchor applicator tool;

pivoting said workhead to apply the anchor onto a foot of a target rail of the track;

retracting said anchor applicator tool; and raising said workhead from said intermediate position to a travel position.

12. The method of claim 11, wherein said pivoting motion of said workhead is in a direction from a gauge side of the rail to a field side of the rail.

13. The method of claim 11, wherein said pivoting motion of said workhead is in the same direction for each of said cribber tool and said anchor applicator tool.

14. A method for applying rail anchors to a railroad track, comprising:

moving a rail cribber and anchor applicator machine along the track to a designated location, the machine having a workhead with at least one anchor applicator tool and at least one cribber tool;

activating at least one rail clamp on the applicator apparatus for holding the machine tightly to the track;

lowering the workhead to an intermediate position;

extending a cribber tool on the workhead from a retracted position to a work position, in which an arm having a ballast pushing surface at a free end is placed adjacent a top surface of the ballast, near a top surface of adjacent rail ties;

extending an anchor applicator tool on the workhead from a retracted position to a work position;

supplying an anchor to a free end of said anchor applicator tool;

pivoting the workhead to create a cribbing action in the ballast, and pivoting the workhead to apply the anchor onto a foot of a target rail of the track;

retracting the anchor applicator tool;

retracting the cribber tool so that a cribber plate is pivoted out of engagement with the anchor; and raising the workhead from the intermediate position to a travel position.

15. The method of claim 14, wherein said cribber tool and said anchor applicator tools are each extended to the work positions simultaneously.

16. An apparatus for cribbing and anchor attachment on rails of a railroad track, comprising:

a frame movable along the track;

at least one dual function workhead mounted to said frame that is moveable into and out of operational position relative to the track;

an anchor applicator tool pivotably mounted to each said workhead;

a cribber tool mounted to each said workhead and adjacent said anchor applicator tool;

each said anchor applicator tool and said cribber tool being movable under operator control relative to said workhead from a retracted to a work position; and said anchor applicator tool and said cribber tool are pivoted together toward a base of the rail for simultaneous cribbing and anchor application.

17. The apparatus of claim 16, wherein said cribber tool has a cribber plate mounted on a free end of a cribber arm, said cribber plate is mounted to said cribber arm to pivot about an axis that is perpendicular to a longitudinal axis of said cribber arm.

18. The apparatus of claim 17, wherein said cribber plate extends toward the rail farther than the anchor applicator tool.

19. The apparatus of claim 17, wherein said anchor applicator tool and said cribber tool are constructed and arranged so that as they are pivoted toward the rail, with an anchor mounted in said anchor applicator tool, said cribber tool clears a path through the ballast just before said anchor applicator applies the anchor to the rail.

20. An apparatus for cribbing and anchor attachment on rails of a railroad track, comprising:

a frame movable along the track;

at least one dual function workhead mounted to said frame that is moveable into and out of operational position relative to the track;

an anchor applicator tool pivotably mounted to each said workhead;

a cribber tool mounted to each said workhead and adjacent said anchor applicator tool;

each said anchor applicator tool and said cribber tool being movable under operator control relative to said workhead from a retracted to a work position; and said anchor applicator tool and said cribber tool are constructed and arranged so that an arc defined by said cribber tool is shorter than an arc defined by said anchor applicator tool.

* * * * *